US005190452A

United States Patent [19]

Katchka et al.

[11] Patent Number: 5,190,452

[45] Date of Patent: Mar. 2, 1993

[54] HEAT EXCHANGER CONTROL SYSTEM, CONTROL VALVE DEVICE THEREFOR AND METHODS OF MAKING THE SAME

[75] Inventors: Jay R. Katchka, Cypress; Nabil M. Haddad, Santa Ana, both of Calif.

[73] Assignee: Robertshaw Controls Company, Richmond, Va.

[21] Appl. No.: 874,722

[22] Filed: Apr. 27, 1992

[51] Int. Cl.[5] ..... F23N 1/00

[52] U.S. Cl. ..... 431/12; 431/90; 126/116 A

[58] Field of Search ..... 431/12, 90; 126/116 A

[56] References Cited

U.S. PATENT DOCUMENTS 2,197,746 4/1940 Matthes ..... 431/90

*Primary Examiner*—Carroll B. Dority

*Attorney, Agent, or Firm*—Candor, Candor & Tassone

[57] ABSTRACT

A heat exchanger control system, an electrically operated control valve device therefor and methods of making the same are provided, the heat exchanger control system comprising an electrically operated control valve device having a housing and a differential pressure operated electrical switch unit being operatively interconnected to structure of the system for supplying combustion air to a burner unit of the system and being adapted to be operated thereby to permit the electrically operated control valve device to be operating only when the pressure value of the air being supplied to the burner unit is at or above a predetermined value so that sufficient combustion air will be supplied to the burner unit before the electrically operated control valve device causes fuel to issue from the burner unit, the differential pressure operated switch unit being carried by the housing so as to be self-contained with the electrically operated control valve device.

20 Claims, 7 Drawing Sheets

HEAT EXCHANGER CONTROL SYSTEM, CONTROL VALVE DEVICE THEREFOR AND METHODS OF MAKING THE SAME

BACKGROUND OF THE INVENTION

1. Field of the Invention

This invention relates to a new heat exchanger control for such a system as well as to new methods of making such a heat exchanger control system and such an electrically operated control valve means.

2. Prior Art Statement

It is known to provide a heat exchanger control system comprising a source of fuel, a burner means for being interconnected to the source of fuel for issuing the fuel therein for burning at the burner means, means for supplying combustion air to the burner means to aid in the burning of the fuel that issues therefrom, electrically operated control valve means operatively interconnected to the burner means and the source of fuel for interconnecting the source of fuel to the burner means when the electrically operated control valve means is in a first operating condition thereof and for disconnecting the source of fuel from the burner means when the electrically operated control valve means is in a second operating condition thereof, and a differential pressure operated electrical switch means operatively interconnected to the electrically operated control valve means to tend to cause the electrically operated control valve means to be in the first condition thereof when the differential pressure operated electrical switch means is in a first condition thereof and to tend to cause the electrically operated control valve means to be in the second condition thereof when the differential pressure operated electrical switch means is in a second condition thereof, the differential pressure operated electrical switch means being operatively interconnected to the means for supplying combustion air and being adapted to be operated thereby from the second condition thereof to the first condition thereof only when the pressure value of the air being supplied to the burner means is at or above a predetermined value whereby sufficient combustion air will be supplied to the burner means before the electrically operated control valve means causes fuel to issue from the burner means, the electrically operated control valve means and the differential pressure operated switch means being separate units so as to be selectively and separately disposed in the system. For example, see FIG. 12 of this application for a schematic showing of such prior known system.

SUMMARY OF THE INVENTION

It is one of the features of this invention to provide a new electrically operated control valve means for a heat exchanger control system wherein a differential pressure operated switch means of the system for sensing a condition of adequate combustion air is carried by the housing means of the electrically operated control valve means so as to be self-contained therewith.

In particular, the prior known heat exchanger control systems each have such a differential pressure operated switch means comprising a separate unit disposed remote from the electrically operated control valve unit while being operatively interconnected thereto.

However, it was found according to the teachings of this invention that the electrically operated control valve means and the differential pressure operated switch means could be combined in a manner so as to be self-contained and still operate as individual units.

In fact, in one embodiment of this invention the electrically operated control valve means and the differential pressure operated switch means are so combined that an exterior wall means of the housing means of the electrically operated control valve means is utilized to form part of an exterior wall means of the differential pressure operated switch means.

For example, one embodiment of this invention comprises a heat exchanger control system comprising a source of fuel, a burner means for being interconnected to the source of fuel for issuing the fuel therein for burning at the burner means, means for supplying combustion air to the burner means to aid in the burning of the fuel that issues therefrom, electrically operated control valve means operatively interconnected to the burner means and the source of fuel for interconnecting the source of fuel to the burner means when the electrically operated control valve means is in a first operating condition thereof and for disconnecting the source of fuel from the burner means when the electrically operated control valve means is in a second operating condition thereof, and a differential pressure operated electrical switch means operatively interconnected to the electrically operated control valve means to tend to cause the electrically operated control valve means to be in the first condition thereof when the differential pressure operated electrical switch means is in a first condition thereof and to tend to cause the electrically operated control valve means to be in the second condition thereof when the differential pressure operated electrical switch means is in a second condition thereof, the differential pressure operated electrical switch means being operatively interconnected to the means for supplying combustion air and being adapted to be operated thereby from the second condition thereof to the first condition thereof only when the pressure value of the air being supplied to the burner means is at or above a predetermined value whereby sufficient combustion air will be supplied to the burner means before the electrically operated control valve means causes fuel to issue from the burner means, the electrically operated control valve means comprising a housing means, the differential pressure operated switch means being carried by the housing means so as to be self-contained with the electrically operated control valve means.

Accordingly, it is an object of this invention to provide a new heat exchanger control system having one or more of the novel features of this invention as set forth above or hereinafter shown or described.

Another object of this invention is to provide a new method of making such a heat exchanger control system, the method of this invention having one or more of the novel features of this invention as set forth above or hereinafter shown or described.

Another object of this invention is to provide a new electrically operated control valve means for such a heat exchanger control system, the electrically operated control valve means of this invention having one or more of the novel features of this invention as set forth above or hereinafter shown or described.

Another object of this invention is to provide a new method of making such an electrically operated control valve means, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
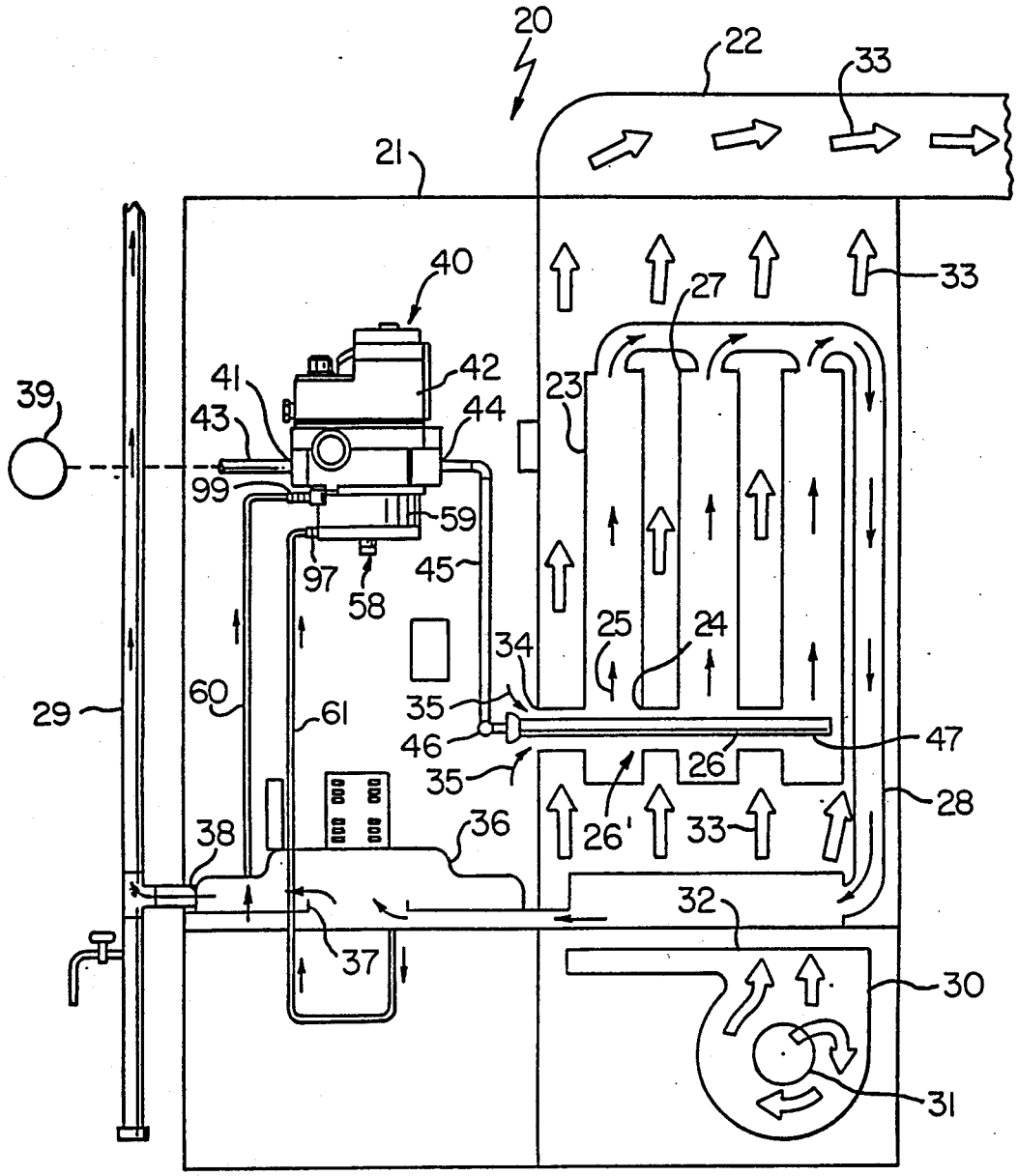
FIG. 1 is a schematic view illustrating the new heat exchanger control system of this invention.

While the various features of this invention are hereinafter illustrated and described as being particularly adapted to provide an electrically operated control valve means for a particular heat exchanger control system, it is to be understood that the various features of this invention can be utilized singly or in various combinations thereof to provide an electrically operated control valve means for other heat exchanger control systems as desired.

Therefore, this invention is not to be limited to only the embodiment illustrated in the drawings, because the drawings are merely utilized to illustrate one of the wide variety of uses of this invention.

Referring now to FIG. 1, the new heat exchanger control system of this invention is generally indicated by the reference numeral 20 and comprises a gas burning furnace 21 having duct means 22 for directing air that has been heated by heat exchanger members 23 formed of any suitable metallic materials and each having an inlet 24 for receiving hot combustion products therein that is indicated by the arrows 25 in the drawings and that is generated by fuel being issued from and burning at a burner means 26 of the furnace 21 in a conventional manner to heat the members 23, the members 23 each having an outlet 27 for directing the combustion products 25 through a venting means 28 that leads to a vent pipe 29 for exhausting the combustion products 25 to the exterior of the building that contains the furnace 21 all in a manner well known in the art.

A blower 30 of the furnace 21 is adapted to receive air through an inlet 31 thereof and be forced out of an outlet 32 thereof to flow in the direction of the arrows 33 over and around the heat exchanger members 23 to be heated thereby and then be directed by the duct means 22 to heat the desired space or rooms as the case may be. In this manner, the air 33 from the blower 30 never mixes with the hot combustion products 25 but is, in effect, heated thereby.

However, in order to provide sufficient air for good combustion of the fuel issuing from the burner means 26, an inlet 34 is provided that leads to the heat exchanger members 23 as well as along the burner means 26 to define a combustion chamber 26' therewith so that air as represented by the arrows 35 in FIG. 1 can be drawn into the inlet 34 to comprise additional combustion air for the fuel issuing from the burner means 26 and such combustion air 35 can be induced to flow into the inlet 34 of the combustion chamber 26' before the burner 26 is operating by the operation of a squirrel cage blower means 36 that is disposed in the vent means 28 so as to have an inlet 37 thereof connected to the vent means 28 and an outlet 38 connected to the vent pipe 29 in the manner illustrated in FIG. 1 whereby the operation of the vent blower means 36 will cause air 35 to flow the inlet 34 of the combustion chamber 26' and to be directed through the heat exchanger members 23 and then through the vent means 28 to the inlet 37 of the blower means 36 to be expelled out of the outlet means 38 thereof into the vent pipe 29 all in the manner well known in the art.

A source 39 of fuel is adapted to be interconnected to the burner means 26 by an electrically operated control valve means of this invention that is generally indicated by the reference numeral 40 in FIG. 1 and is supported in the furnace 21 in any suitable manner. The electrically operated control valve means 40 has an inlet 41 of a housing means 42 thereof interconnected to the source 39 of fuel by suitable conduit means 43 and an outlet 44 thereof interconnected to the burner means 26 by suitable conduit means 45 that includes a manifold 46 for conveying the fuel to a plurality of burner tubes 47 that are arranged in side-by-side spaced apart parallel relation in the combustion chamber 26' and have a plurality of ports (not shown) formed therein for issuing the fuel therefrom to burn externally thereto all in a manner well known in the art.

However, the electrically operated control valve means 40 has valve means (not shown) therein that will only open to permit fuel to flow from the inlet 41 to the outlet 44 when certain solenoid means (not shown) thereof is electrically operated to an "on" condition thereof as will be apparent hereinafter.

As previously stated, it is known to provide a differential pressure operated electrical switch means which will prevent the electrically operated control valve means 40 from directing fuel to the burner means 26 should sufficient combustion air 35 not be provided for the burner means 26.

Figure 12:
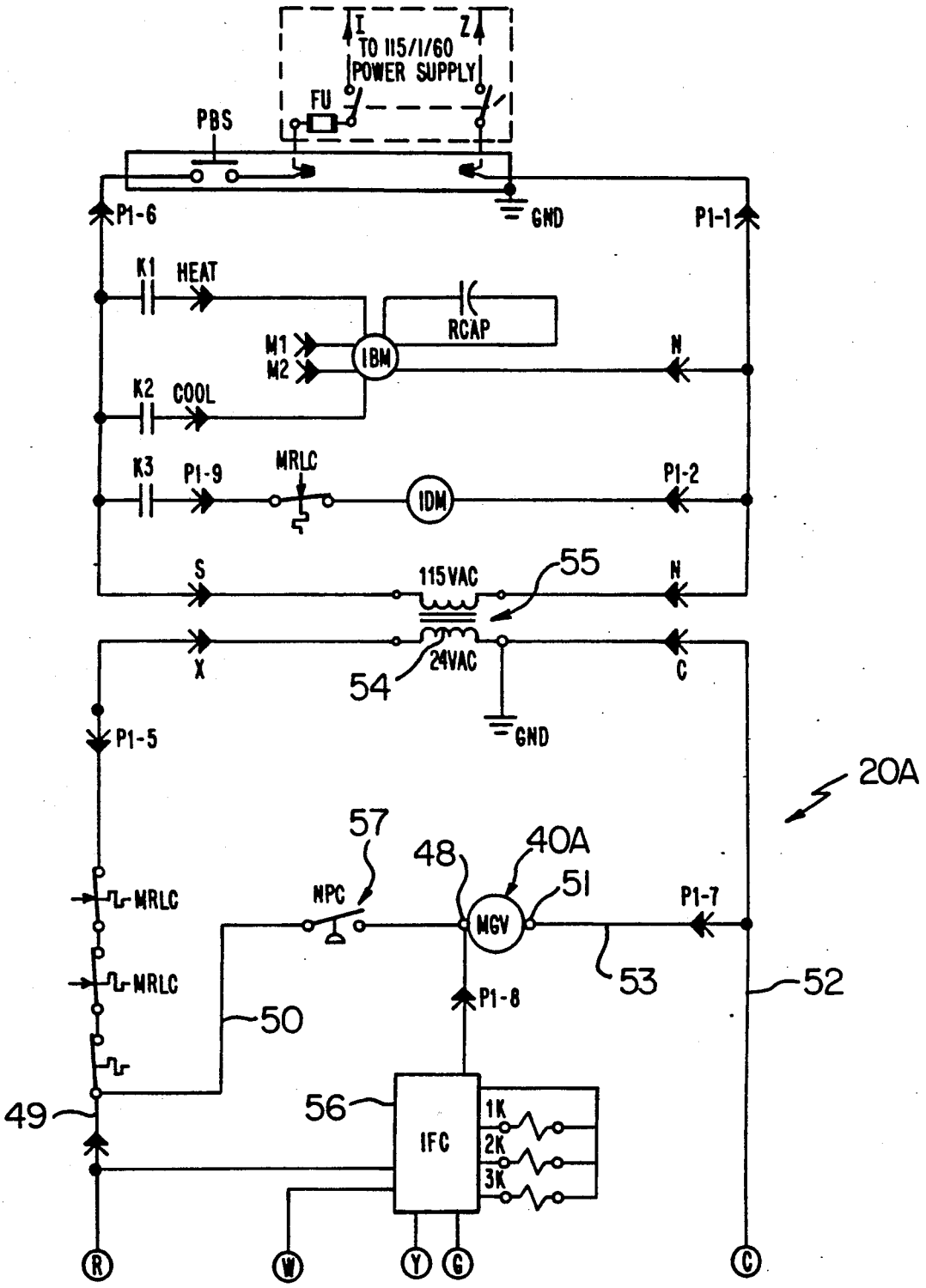
FIG. 12 is a schematic view illustrating a prior known heat exchanger control system.

For example, such a prior known heat exchanger control system is generally indicated by the reference numeral 20A in FIG. 12 and parts thereof similar to the system 20 of this invention are indicated by like reference numerals followed by the reference letter "A".

As illustrated in FIG. 12, an electrically operated control valve means 40A has one side 48 thereof interconnected to one power source lead means 49 by a lead means 50 and has another side 51 thereof interconnected to another power source lead means 52 by a lead means 53, the lead means 49 and 52 being respectively interconnected to a winding 54 of a transformer 55 that will supply alternating current at a predetermined voltage through the lines 49 and 52 in a manner well known in the art to tend to operate the valve means 40A to an open condition thereof when a control means 56 determines that heat should be supplied by the system 20A.

However, it can be seen in FIG. 12 that a differential pressure operated electrical switch means 57 is disposed in the line means 50 and that the switch means 57 must be in a closed condition thereof before the electrically operated control valve means 40A is interconnected across the power lines 49 and 50. Such differential pressure operated electrical switch means 57 can be arranged to be responsive to the value of the combustion air being supplied to a burner means so that a vent blower means must be operating before the differential pressure operated switch means 57 will close and, thus, must be sufficiently operating before the electrically operated control valve means 40A can be operated to interconnect a fuel source to the burner means of the system 20A. Of course, when the means 56 determines that the electrically operated control valve means 40A should discontinue the flow of fuel therethrough, the means 56 terminates the supply of electrical current to the electrically operated control valve means so the valve means thereof will close.

As previously stated, it is one of the features of this invention to have the housing means 42 of the electrically operated control valve means 40 of this invention carry such a differential pressure operated switch means and such differential pressure operated switch means of this invention is generally indicated by the reference numeral 58 and comprises a housing means 59 secured to the housing means 42 in a manner hereinafter set forth so that the differential pressure operated switch means 58 is self-contained with the electrically operated control valve means 40 so that the same can be disposed as a single unit in the control system 20 and prevent the electrically operated control valve means 40 from interconnecting the fuel source 39 to the burner means 26 until sufficient combustion air 35 has been induced into the inlet 34 to provide for sufficient combustion air in the combustion chamber 26' for the burner means 26.

In particular, the differential pressure operated switch means 58 can be so constructed and arranged as will be apparent hereinafter that the same is adapted to sense the high outlet pressure of the vent blower 36 by being interconnected to a conduit means 60 and to sense a low or negative pressure such as by being interconnected to the inlet 37 of the vent blower 36 by a conduit means 61.

In this manner, the resulting differential pressure between the high pressure source of the outlet 38 of the vent blower 36 and the low pressure at the inlet 37 of the vent blower 36 will cause the differential pressure operated switch means 58 to be in a condition thereof that will permit the electrically operated control valve means 40 to interconnect the fuel source 39 to the burner means 26 only when the blower 36 is operating in a sufficient manner so that proper combustion air will be supplied to the burner means 26.

While the electrically operated control valve means 40 of this invention can take any suitable form, the particular electrically operated fuel control valve means 40 of this invention that is illustrated in the drawings comprises an electrically operated control valve means that is fully disclosed and claimed in the U.S. Pat. et. al., No. 5,044,390 whereby this U.S. patent is being incorporated into this disclosure by this reference thereto.

Therefore, since the details of the structure and operation of an electrically operated control valve means is well known in the art, a further description of the details and operation of the control valve means 40 is deemed unnecessary except to state that the same will only open the valve means thereof to interconnect the source 39 of fuel to the burner means 26 when a thermostat means tries to place a solenoid means of the valve means across a power source in a manner similar to the system 20A of FIG. 12 and the solenoid valve means can only be placed across the electrical power source when the differential pressure operated switch means 58 is in a closed condition in a manner similar to the differential pressure operated switch means 57 of FIG. 12 as will be apparent hereinafter.

In one working embodiment of this invention, the new electrically operated control valve means 40 of this invention comprises the prior known electrically operated control valve means 40A of FIGS. 9–12 being combined with the differential pressure operated switch means 58 in a unique manner, the prior known electrically operated control valve means 40A having the housing means 42 thereof comprising a cup-shaped member 62 having a closed end 63 and an open end 64 defined by a substantially flat surrounding flange means 65 which is secured to another section 66 of the housing means 42 by a plurality of threaded fastening means 67.

Figure 4:
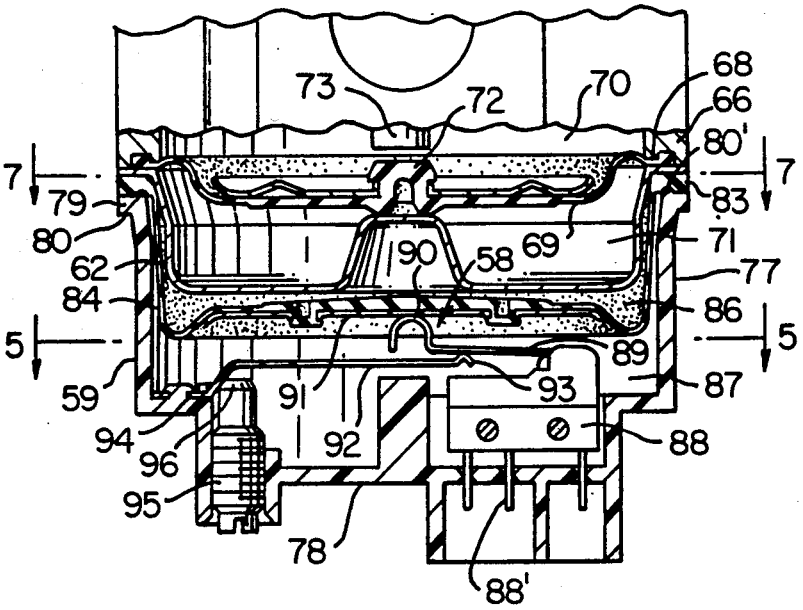
FIG. 4 is a fragmentary cross-sectional view taken on line 4—4 of FIG. 2.

It can be seen in FIG. 4 that the cup-shaped housing member 62 cooperates with the housing section 66 to hold an outer peripheral means 68 of a flexible diaphragm 69 thereto so that the diaphragm 69 defines a pair of chambers 70 and 71 on opposite sides thereof with the chamber 71 being defined between the diaphragm 69 and the cup-shaped member 62. The diaphragm 69 has a medial portion 72 that is adapted to cooperate with a valve member actuator 73 for opening and closing a valve seat (not shown) in the manner fully set forth in the aforementioned patent to Kelly et. al., U.S. Pat. No. 5,044,390.

Figure 11:
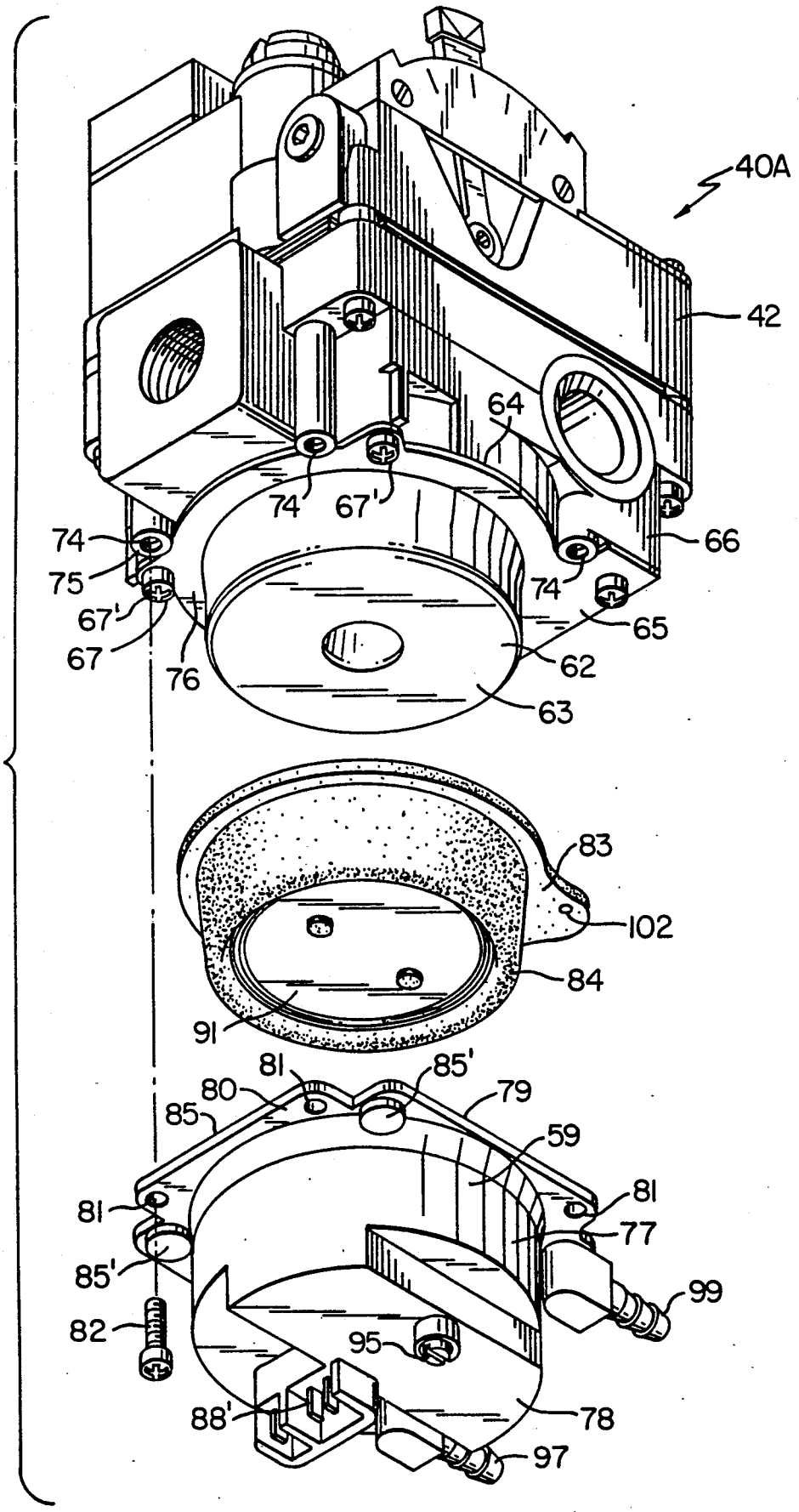
FIG. 11 is an exploded perspective view of the various parts of the electrically operated control valve means of this invention.

The housing means 42 of the prior known electrically operated control valve means 40A is modified to have a plurality of threaded openings 74 which terminate at substantially flat annular portions 75 that are disposed substantially coplanar with the flat outer surface 76 of the flange 65 of the cup-shaped member 62 in the manner illustrated in FIG. 11.

The housing means 59 of the differential pressure operated switch means 58 of this invention comprises a cup-shaped member 77 having a closed end 78 and an open end 79 defined by a surrounding flat flange means 80 that is provided with a plurality of openings 81 therethrough for receiving threaded fastening members 82 therethrough which will thread into the threaded openings 74 of the housing means 42 to fasten the cup-shaped housing member 77 thereto in the manner illustrated in FIG. 4, the housing member 77 having the flange 80 thereof cooperating with an annular surrounding flange 83 of a cup-shaped flexible diaphragm means 84 to seal the flange 83 of the diaphragm means 84 between the side 85 of the flange 80 of the cup-shaped housing member 77 and the surface 76 of the flange 65 of the cup-shaped housing member 62 so that the flexible diaphragm means 84 defines a pair of chambers 86 and 87 on opposite sides thereof with the chamber 86 being disposed between the diaphragm means 84 and the cup-shaped housing member 62 of the housing means 42 whereby the cup-shaped housing member 62 of the housing means 42 comprises an exterior wall means of the housing means 42 and also forms an exterior wall of the differential pressure operated switch means 58 as the same cooperates with the diaphragm means 84 in forming the chamber 86 therewith.

The other chamber 87 of the differential pressure operated switch means 58 is defined between the diaphragm means 84 and the cup-shaped housing member 77 and receives an electrical switch unit 88 therein which is fastened in any suitable manner to the closed wall 78 of the cup-shaped member 77 and has a movable actuator 89 provided with an end 90 that is held against a medial portion 91 of the diaphragm means 84 by a leaf spring 92 so that the actuator 89 will follow the upward and downward movement of the diaphragm 84 for a purpose hereinafter set forth.

The leaf spring 92 has opposed ends 93 and 94 with the end 94 being fastened to the housing member 77 and with the end 93 being disposed in engagement with the actuator 89, the force of the leaf spring 92 acting against the actuator 89 to tend to prevent movement of the diaphragm 84 downwardly in FIG. 4 being adjusted by an adjusting member 95 threadedly carried by the housing means 77 and having an end 96 bearing against the spring lever 92 intermediate the ends 93 and 94 thereof.

In this manner, the force of the leaf spring 92 can be utilized to calibrate the differential pressure operated switch means 58 so that the diaphragm means 84 thereof will only cause the electrical switch unit 88 to be operated to an "on" condition thereof when the pressure differential acting across the diaphragm means 84 is at or above a certain value, such as when the chamber 86 receives a certain high pressure and the chamber 87 receives a certain low pressure as will be apparent hereinafter. Of course, when the pressure differential acting across the diaphragm means 84 falls below this certain value, the leaf spring 92 causes the diaphragm means 84 to move upwardly and cause the electrical switch unit to be operated to its "off" condition.

Figure 6:
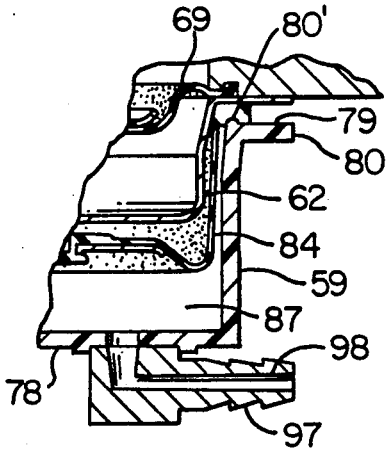
FIG. 6 is a fragmentary cross-sectional view taken on line 6—6 of FIG. 5.
Figure 5:
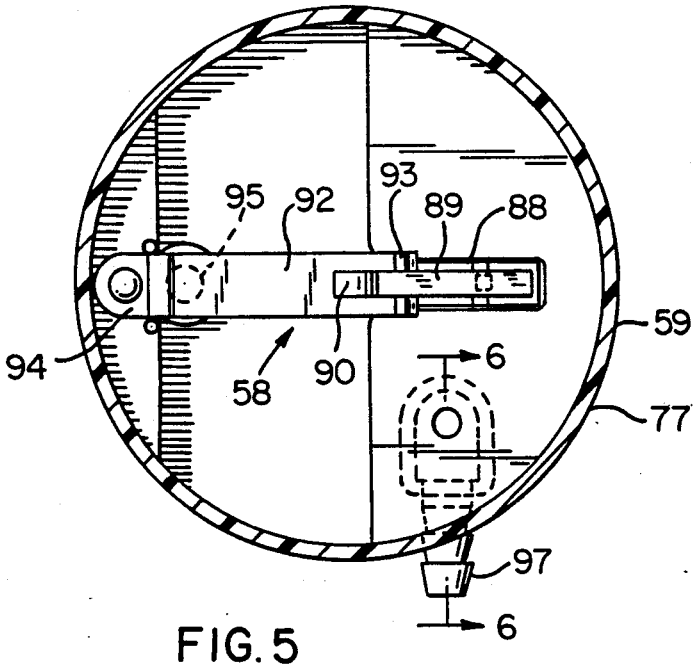
FIG. 5 is a cross-sectional view taken on line 5—5 of FIG. 4.

The cup-shaped housing member 77 of the differential pressure operated switch means 58 is provided with a nipple means 97 that has an opening means 98 passing therethrough that leads to the chamber 87 in the manner illustrated in FIG. 6. Similarly, the flange 80 of the cup-shaped housing member 77 of the differential pressure operated switch means 58 carries a nipple means 99 that has an opening 100 passing therethrough that leads to the chamber means 86 in the manner illustrated in FIG. 8, the flange 80 of the cup-shaped housing member 77 having an orifice means 101 passing therethrough and passing through an opening 102 in the flange 83 of the flexible diaphragm 84 so as to communicate the passage or opening 100 with the chamber 86 in the manner illustrated in FIGS. 7 and 8.

Thus, the conduits 60 and 61 can be respectively fluidly interconnected to the nipples 99 and 97 by being slipped thereon in a sealing manner well known in the art so that the conduit means 60 will interconnect the outlet 38 of the vent blower 36 to the high pressure chamber 86 and the conduit 61 will interconnect the inlet 37 of the vent blower 36 to the low pressure chamber 87 in a manner illustrated in FIG. 1 so that the diaphragm means 84 will be responsive to the difference in the pressure between the outlet 38 of the vent blower 36 and the inlet 37 of the vent blower 36 for the reasons previously set forth whereby the electrical switch unit 88 will only be turned to its "on" condition when the diaphragm means 84 has been moved downwardly from the position illustrated in FIG. 4 in opposition to the force of the leaf spring 92 when a certain pressure value exists across the diaphragm means 84 and such certain pressure is a pressure that ensures that sufficient air 35 for combustion at the burner means 26 in the combustion chamber 26' is being supplied by the vent blower 36 before the switch unit 88 will be turned "on" and thereby permit electrical current to be directed to the electrically operated portion of the electrically operated control valve means 40 so that the electrically operated control valve means 40 can interconnect the source 39 of fuel to the burner means 26 for the same reasons as set forth in the prior known arrangement of FIG. 12 wherein the switch means 57 must be disposed in a closed condition before the valve means 40A will be supplied electrical current to permit the same to open and interconnect a fuel source to the burner means.

Therefore, it can be seen that it is a relatively simple method of this invention to convert the prior known electrically operated control valve means 40A to the electrically operated control valve means 40 of this invention by combining the differential pressure operated switch means 58 of this invention thereto so as to be carried by the housing means 42 in a self-contained manner with the resulting electrically operated control valve means 40 of this invention.

Figure 3:
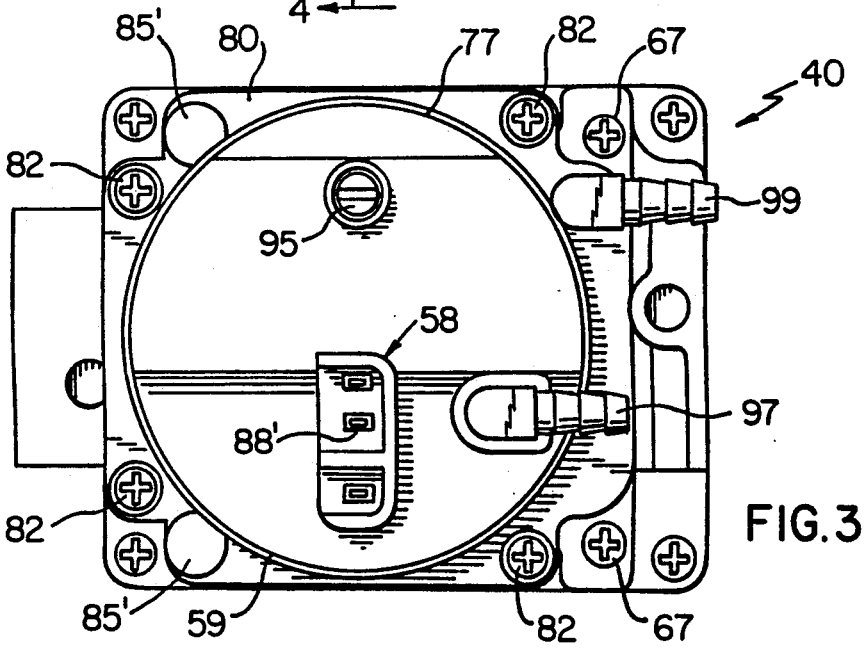
FIG. 3 is a bottom view of the electrically operated control valve means illustrated in FIG. 2 and is taken in the direction of the arrows 3—3 of FIG. 2.
Figure 7:
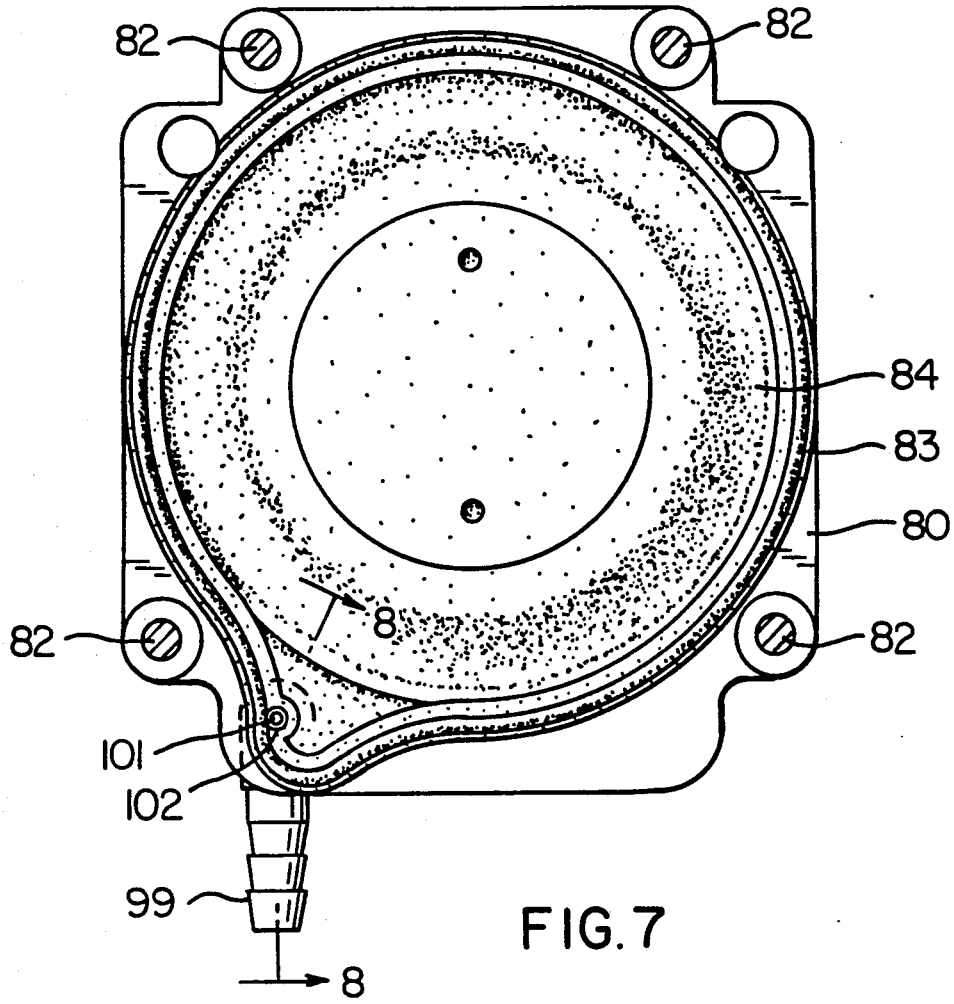
FIG. 7 is a cross-sectional view taken on line 7—7 of FIG. 4.

For example, as previously stated, the cup-shaped housing member 59 can be fastened to the housing means 42 over the cup-shaped housing member 62 by the fastening members 82 so as to trap the diaphragm means 84 therebetween in a sealing manner, the flange 80 of the cup-shaped housing member 59 having two depressions, FIG. 7, in the surface 85 thereof and covered by the resulting embossments 85', FIG. 3, so as to accept the enlarged heads 67' of two of the fastening members 67 for the cup-shaped housing member 62 therein to permit the flange surface 85 of the flexible diaphragm means 84 to be in sealing relation with the surface 76 of the flange means 65 of the cup-shaped housing member 62. In this manner, the housing means 42 of the prior known electrically operated control valve means 40A is converted to the self-contained electrically operated control valve means 40 of this invention.

Figure 8:
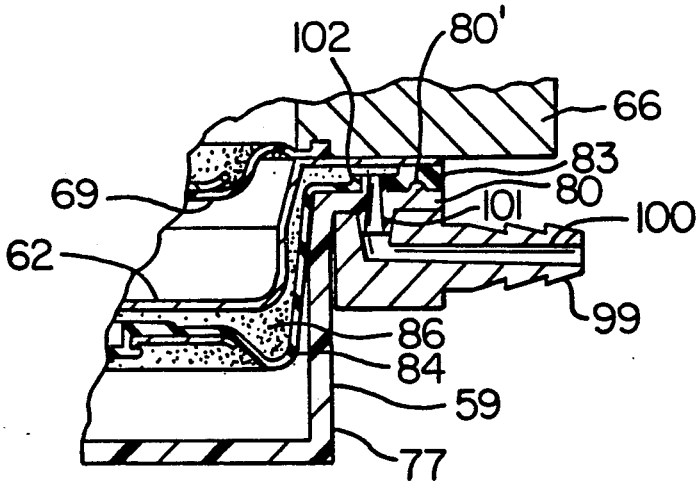
FIG. 8 is a fragmentary cross-sectional view taken on line 8—8 of FIG. 7.

If it is desired to further ensure the sealing relationship of the flange 83 of the diaphragm means 84 against the surface 76 of the cup-shaped housing member 62, the surface 85 of the cup-shaped housing member 59 can be provided with a continuous projection means 80' as illustrated in FIGS. 4, 6 and 8 to embed into the peripheral flange 83 of the diaphragm means 84 for such sealing relationship therewith as is well known in the art.

Figure 2:
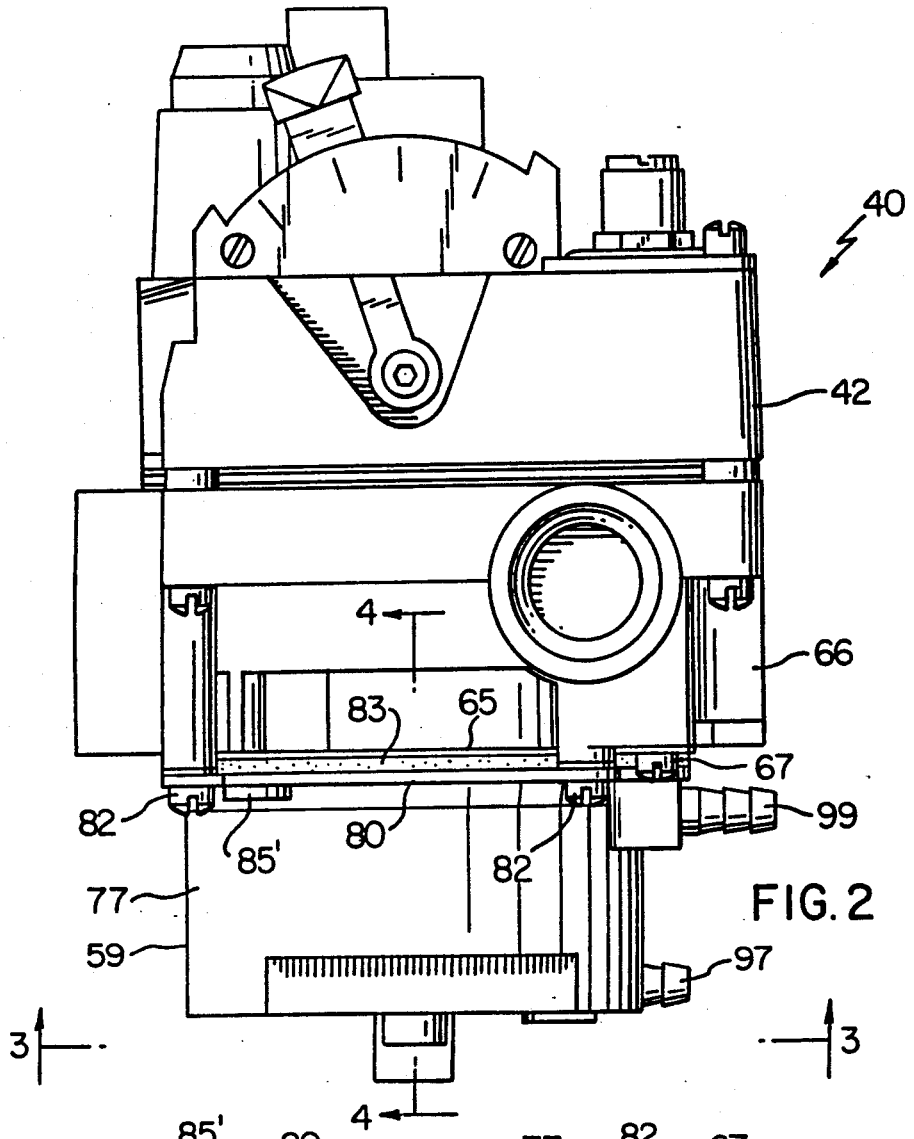
FIG. 2 is an enlarged side view of the new electrically operated control valve means of this invention that is utilized in the system of FIG. 1.
Figure 9:
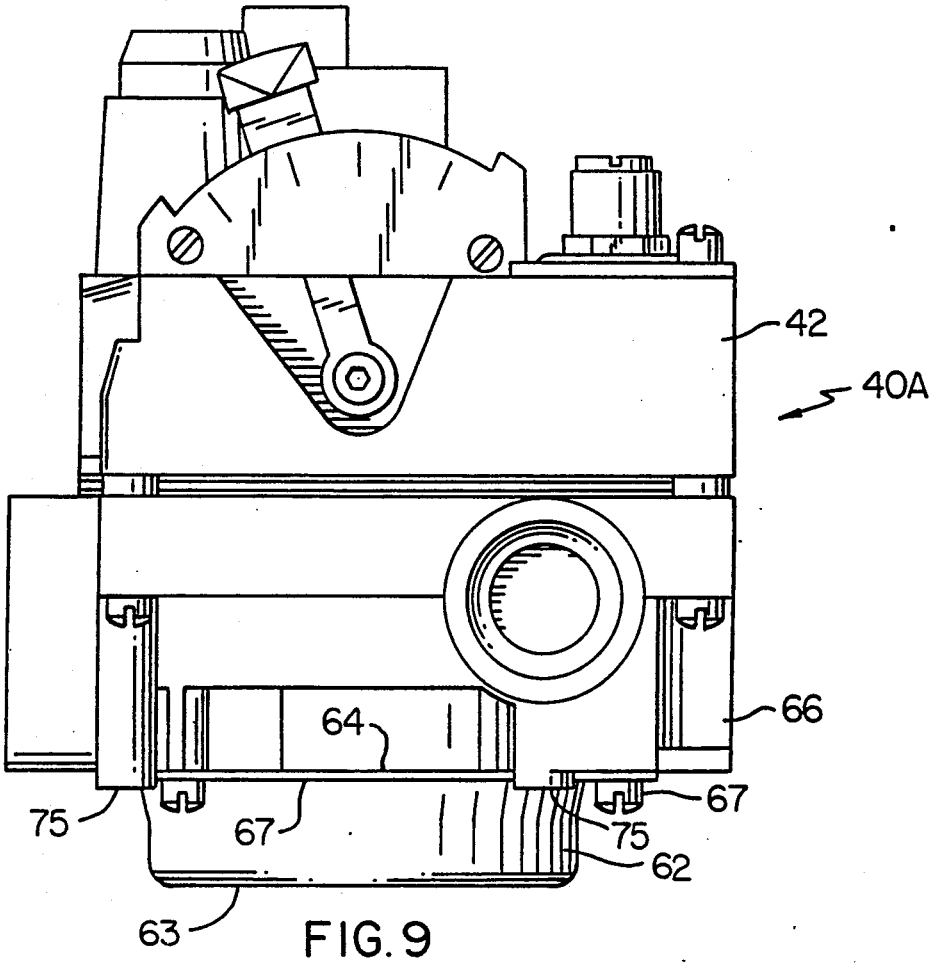
FIG. 9 is a side view of a prior known electrically operated control valve means that is uniquely combined with a differential pressure operated switch means of this invention to form the electrically operated control valve means of this invention that is illustrated in FIGS. 1–8.
Figure 10:
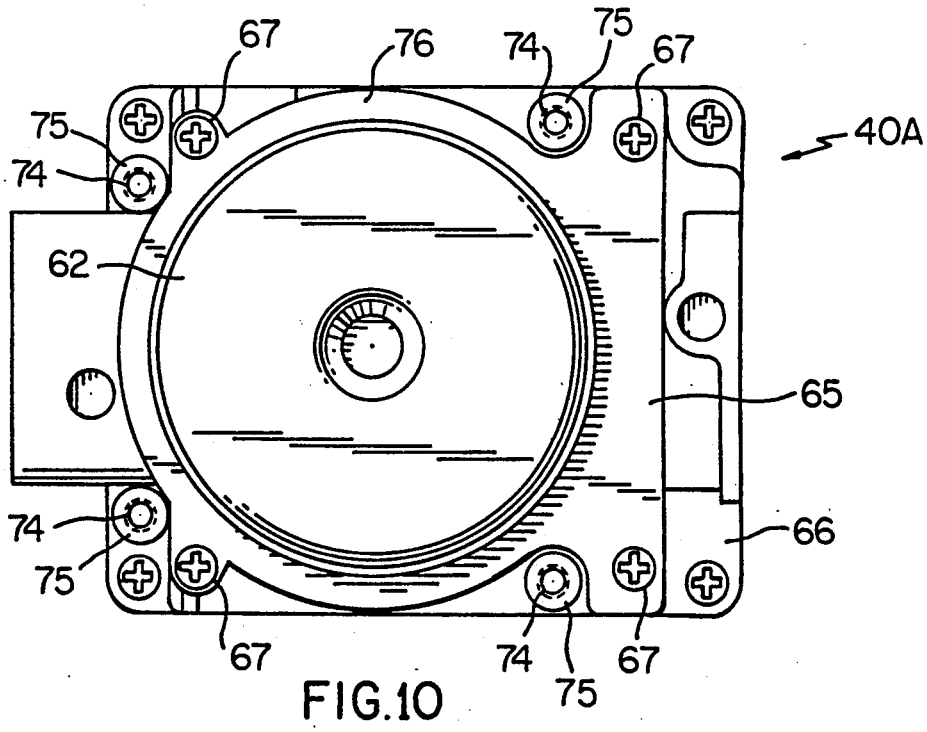
FIG. 10 is a bottom view of the electrically operated control valve means of FIG. 9 and is taken in the direction of the arrows 10—10 thereof.

This unique conversion of the prior known electrically operated control valve means 40A to the self-contained arrangement of the electrically operated control valve means 40 of this invention can readily be seen when comparing the prior known electrically operated control valve means 40A of FIGS. 9 and 10 with the electrically operated control valve means 40 of this invention as set forth in corresponding FIGS. 2 and 3.

The resulting electrically operated control valve means 40 of this invention readily permits the same to be disposed in the system 20 in the manner illustrated in FIG. 1 as a single unit to be respectively interconnected to the conduits 43, 45, 60 and 61 and have suitable electrical lines interconnected to terminal means (not shown) on the housing means 42 and to terminal means 88' of the switch unit 88 to cause the heat exchanger system 21 to operate in the manner previously set forth so that the fuel flow to the burner means 26 will not take place until after the blower 36 is properly operating to cause the electrical switch unit 88 of the differential pressure operated switch means 58 to close and thereby permit the electrically operated valve means (not shown) in the housing means 42 to open and interconnect the fuel source conduit 43 with the outlet conduit 45 that feeds the burner means 26.

However, when the vent blower motor 36 ceases to operate, the differential pressure operated switch means 58 has the actuator 93 of the electrical switch unit 88 moved to an open condition to terminate the electrical current flow to the electrically operated valve means (not shown) in the housing means 42 to terminate the flow of fuel to the burner means 26, such electrical operation of the valve means in the housing means 42 being fully set forth in the aforementioned U.S. Pat. to Kelly et. al., No. 5,044,390, and need not be further described.

In this manner, it can be seen that the electrically operated control valve means 40 of this invention ensures that fuel will not be directed to the burner means 26 until the pressure value of the combustion air 35 being supplied to the burner means 26 is at or above a predetermined value (as set by the adjustment member 95).

Thus, it can be seen that this invention not only provides a new heat exchanger system and method of making the same, but also this invention provides a new electrically operated control valve means and method of making the same.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a heat exchanger control system comprising a source of fuel, a burner means for being interconnected to said source of fuel for issuing said fuel therein for burning at said burner means, means for supplying combustion air to said burner means to aid in said burning of said fuel that issues therefrom, electrically operated control valve means operatively interconnected to said burner means and said source of fuel for interconnecting said source of fuel to said burner means when said electrically operated control valve means is in a first operating condition thereof and for disconnecting said source of fuel from said burner means when said electrically operated control valve means is in a second operating condition thereof, and a differential pressure operated electrical switch means operatively interconnected to said electrically operated control valve means to tend to cause said electrically operated control valve means to be in said first condition thereof when said differential pressure operated electrical switch means is in a first condition thereof and to tend to cause said electrically operated control valve means to be in said second condition thereof when said differential pressure operated electrical switch means is in a second condition thereof, said differential pressure operated electrical switch means being operatively interconnected to said means for supplying combustion air and being adapted to be operated thereby from said second condition thereof to said first condition thereof only when the pressure value of said air being supplied to said burner means is at or above a predetermined value whereby sufficient combustion air will be supplied to said burner means before said electrically operated control valve means causes fuel to issue from said burner means, said electrically operated control valve means comprising a housing means, the improvement wherein said differential pressure operated switches means is carried by said housing means so as to be self-contained with said electrically operated control valve means.

2. A system as set forth in claim 1 wherein said housing means has an exterior wall means, said differential pressure operated switch means using part of said exterior wall means to define an exterior wall thereof.

3. A system as set forth in claim 2 wherein said differential pressure operated switch means has a housing means and a flexible diaphragm means disposed therein and dividing said housing means thereof into two chambers respectively disposed on opposite sides of said flexible diaphragm means, said part of said exterior wall means of said control valve means cooperating with said housing means of said differential pressure operated electrical switch means to define part of one of said two chambers thereof.

4. A system as set forth in claim 3 wherein said housing means of said differential pressure operated electrical switch means comprises a cup-shaped member having a closed end and an open end, said open end of said cup-shaped member being closed by said part of said exterior wall means of said electrically operated control valve means.

5. A system as set forth in claim 4 wherein said flexible diaphragm means has an outer peripheral means disposed between said open end of said cup-shaped member and said part of said exterior wall means to seal said open end to said part of said exterior wall means.

6. A system as set forth in claim 5 wherein said part of said exterior wall means of said electrically operated control valve means comprises a cup-shaped member having an open end and a closed end, said closed end of said cup-shaped member of said electrically operated control valve means comprising said exterior wall of said differential pressure operated switch means.

7. A system as set forth in claim 1 wherein said differential pressure operated switch means comprises a housing means having a flexible diaphragm means defining two chambers on opposite sides of said diaphragm means.

8. A system as set forth in claim 7 wherein said differential pressure operated switch means comprises an electrical switch unit disposed in one of said two chambers and being operatively associated with said diaphragm means to be operated thereby.

9. A system as set forth in claim 8 wherein said means for supplying combustion air comprises blower means having a high pressure side and a low pressure side, said system having means interconnecting said high pressure side to one of said two chambers of said differential pressure operated switch means.

10. A system as set forth in claim 9 wherein said means for supplying combustion air comprises vent means for the combustion products of said burner means and said blower means being adapted to induce a flow through said vent means.

11. In an electrically operated control valve means for a heat exchanger control system comprising a source of fuel, a burner means for being interconnected to said source of fuel for issuing said fuel therein for burning at said burner means when said electrically operated control valve means is in a first operating condition thereof and for being disconnected from said source of fuel when said electrically operated control valve means is in a second operating condition thereof, means for supplying combustion air to said burner means to aid in said burning of said fuel that issues therefrom, and a differential pressure operated electrical switch means operatively interconnected to said electrically operated control valve means to tend to cause said electrically operated control valve means to be in said first condition thereof when said differential pressure operated electrical switch means is in a first condition thereof and to tend to cause said electrically operated control valve means to be in said second condition thereof when said differential pressure operated electrical switch means is in a second condition thereof, said differential pressure operated electrical switch means being adapted to be operatively interconnected to said means for supplying combustion air and being adapted to be operated thereby from said second condition thereof to said first condition thereof only when the pressure value of said air being supplied to said burner means is at or above a predetermined value whereby sufficient combustion air will be supplied to said burner means before said electrically operated control valve means causes fuel to issue from said burner means, said electrically operated control valve means comprising a housing means, the improvement wherein said differential pressure operated switch means is carried by said housing means so as to be self-contained with said electrically operated control valve means.

12. An electrically operated control valve means as set forth in claim 11 wherein said housing means has an exterior wall means, said differential pressure operated switch means using part of said exterior wall means to define an exterior wall thereof.

13. An electrically operated control valve means as set forth in claim 12 wherein said differential pressure operated switch means has a housing means and a flexible diaphragm means disposed therein and dividing said housing means thereof into two chambers respectively disposed on opposite sides of said flexible diaphragm means, said part of said exterior wall means of said control valve means cooperating with said housing means of said differential pressure operated electrical switch means to define part of one of said two chambers thereof.

14. An electrically operated control valve means as set forth in claim 13 wherein said housing means of said differential pressure operated switch means comprises a cup-shaped member having a closed end and an open end, said open end of said cup-shaped member being closed by said part of said exterior wall means of said electrically operated control valve means.

15. An electrically operated control valve means as set forth in claim 14 wherein said flexible diaphragm means has an outer peripheral means disposed between said open end of said cup-shaped member and said part of said exterior wall means to seal said open end to said part of said exterior wall means.

16. An electrically operated control valve means as set forth in claim 15 wherein said part of said exterior wall means of said electrically operated control valve means comprises a cup-shaped member having an open end and a closed end, said closed end of said cup-shaped member of said electrically operated control valve means comprising said exterior wall of said differential pressure operated switch means.

17. An electrically operated control valve means as set forth in claim 11 wherein said differential pressure operated switch means comprises a housing means having a flexible diaphragm means defining two chambers on opposite sides of said diaphragm means.

18. An electrically operated control valve means as set forth in claim 17 wherein said differential pressure operated switch means comprises an electrical switch unit disposed in one of said two chambers and being operatively associated with said diaphragm means to be operated thereby.

19. In a method of making a heat exchanger control system comprising a source of fuel, a burner means for being interconnected to said source of fuel for issuing said fuel therein for burning at said burner means, means for supplying combustion air to said burner means to aid in said burning of said fuel that issues therefrom, electrically operated control valve means operatively interconnected to said burner means and said source of fuel for interconnecting said source of fuel to said burner means when said electrically operated control valve means is in a first operating condition thereof and for disconnecting said source of fuel from said burner means when said electrically operated control valve means is in a second operating condition thereof, and a differential pressure operated electrical switch means operatively interconnected to said electrically operated control valve means to tend to cause said electrically operated control valve means to be in said first condition thereof when said differential pressure operated electrical switch means is in a first condition thereof and to tend to cause said electrically operated control valve means to be in said second condition thereof when said differential pressure operated electrical switch means is in a second condition thereof, said differential pressure operated electrical switch means being operatively interconnected to said means for supplying combustion air and being adapted to be operated thereby from said second condition thereof to said first condition thereof only when the pressure value of said air being supplied to said burner means is at or above a predetermined value whereby sufficient combustion air will be supplied to said burner means before said electrically operated control valve means causes fuel to issue from said burner means, said electrically operated control valve means comprising a housing means, the improvement comprising the step of forming said differential pressure operated switch means to be carried by said housing means and thereby be self-contained with said electrically operated control valve means.

20. In a method of making an electrically operated control valve means for a heat exchanger control system comprising a source of fuel, a burner means for being interconnected to said source of fuel for issuing said fuel therein for burning at said burner means when said electrically operated control valve means is in a first operating condition thereof and for being disconnected from said source of fuel when said electrically operated control valve means is in a second operating condition thereof, means for supplying combustion air to said burner means to aid in said burning of said fuel that issues therefrom, and a differential pressure operated electrical switch means operatively interconnected to said electrically operated control valve means to tend to cause said electrically operated control valve means to be in said first condition thereof when said differential pressure operated electrical switch means is in a first condition thereof and to tend to cause said electrically operated control valve means to be in said second condition thereof when said differential pressure operated electrical switch means is in a second condition thereof, said differential pressure operated electrical switch means being adapted to be operatively interconnected to said means for supplying combustion air and being adapted to be operated thereby from said second condition thereof to said first condition thereof only when the pressure value of said air being supplied to said burner means is at or above a predetermined value whereby sufficient combustion air will be supplied to said burner means before said electrically operated control valve means causes fuel to issue from said burner means, said electrically operated control valve means comprising a housing means, the improvement comprising the step of forming said differential pressure operated switch means to be carried by said housing means and thereby be self-contained with said electrically operated control valve means.

* * * * *